US006354817B1

(12) United States Patent
Chang

(10) Patent No.: US 6,354,817 B1
(45) Date of Patent: Mar. 12, 2002

(54) PRESSURIZED AIR SUPPLYING DEVICE FOR VEHICLE

(76) Inventor: Horng Jiun Chang, No. 26-23, Tien Chong Yian Lane, Yuan Lin Town, Chang Hua Hsien (TW), 510

( * ) Notice: Subject to any disclaimer, the term of this patent is extended or adjusted under 35 U.S.C. 154(b) by 0 days.

(21) Appl. No.: 09/476,336

(22) Filed: Jan. 3, 2000

(51) Int. Cl.[7] ..... F04B 17/00
(52) U.S. Cl. ..... 417/413.1; 92/140; 92/129
(58) Field of Search ..... 417/413.1, 415, 417/534; 92/140, 129

(56) References Cited

U.S. PATENT DOCUMENTS 2,930,324 A * 3/1960 Toulmin, Jr. ..... 103/53
3,635,592 A * 1/1972 Kolfertz ..... 417/413
4,154,559 A * 5/1979 Enomoto ..... 417/413
4,252,510 A * 2/1981 Bromley ..... 417/534
4,636,149 A * 1/1987 Brown ..... 417/322
4,737,083 A * 4/1988 Meyer ..... 417/413
5,358,385 A * 10/1994 Wang ..... 417/44.8

* cited by examiner

*Primary Examiner*—Charles G. Freay
*Assistant Examiner*—William H Rodriguez
(74) *Attorney, Agent, or Firm*—Charles E. Baxley

(57) ABSTRACT

A pressurized air supplying device is coupled to the DC electric power of the vehicle for supplying a pressurized air to a massage device of the vehicle. The pressurizing device includes two membranes secured to two sides of a housing and each having a peripheral portion secured to the housing with a casing. A follower is secured between the membranes. A motor is secured to the housing and has an eccentric axle slidably engaged through the follower to actuate the follower and the membranes to pressurize the air and to generate a pressurized air to the massage device.

5 Claims, 3 Drawing Sheets

PRESSURIZED AIR SUPPLYING DEVICE FOR VEHICLE

BACKGROUND OF THE INVENTION

1. Field of the Invention

The present invention relates to a pressurized air generating device, and more particularly to a pressurized air supplying device for a vehicle.

2. Description of the Prior Art

Typical vehicles comprise various kinds of massage apparatus including a mechanical structure having one or more massage rollers or wheels engaged with the users and driven by motors to massage the users. The users may not feel much comfort when massaged with the massage wheels and rollers.

The present invention has arisen to mitigate and/or obviate the afore-described disadvantages of the conventional pressurized air supplying devices for vehicles.

SUMMARY OF THE INVENTION

The primary objective of the present invention is to provide a pressurized air supplying device for supplying a pressurized air to a vehicle and to actuate the pneumatic activated massage devices of the vehicle.

In accordance with one aspect of the invention, there is provided a pressurized air supplying device for generating and supplying a pressurized air to a massage device of a vehicle, the pressurized air supplying device comprising a housing including a pair of opposite sides each having an opening formed therein, a pair of membranes secured to the opposite sides of the housing respectively for enclosing the openings of the housing, the membranes each including a peripheral portion, a pair of casings secured to the opposite sides of the housing and engaged with the peripheral portions of the membranes to secure the peripheral portions of the membranes between the housings and the casings, the casings each including an outlet port for outputting air, and means for moving the membranes relative to the casings to pressurize the air in the casings and to generate a pressurized air out through the outlet ports of the casings respectively.

The moving means includes a follower slidably received in the housing and having two sides secured to the membranes respectively for moving the membranes relative to the casings respectively, and means for actuating the follower to move the membranes relative to the casings respectively. The follower includes an oblong hole formed therein, the actuating means includes a motor having an eccentric axle engaged in the oblong bole of the follower to actuate the follower and to move the membranes relative to the casings.

The follower includes two sides each having an ear provided thereon, a pair of fasteners secured in the ears of the follower respectively and secured to the membranes for securing the sides of the follower to the membranes. The ears each includes a groove formed therein for receiving the fastener, and each includes a shoulder formed therein, the fasteners each includes a head engaged with the shoulder of the ear for securing the fastener to the ear respectively.

The casings each includes a check valve attached thereto to control the air to flow into the casings only and to prevent the air in the casings from flow out of the casings respectively.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
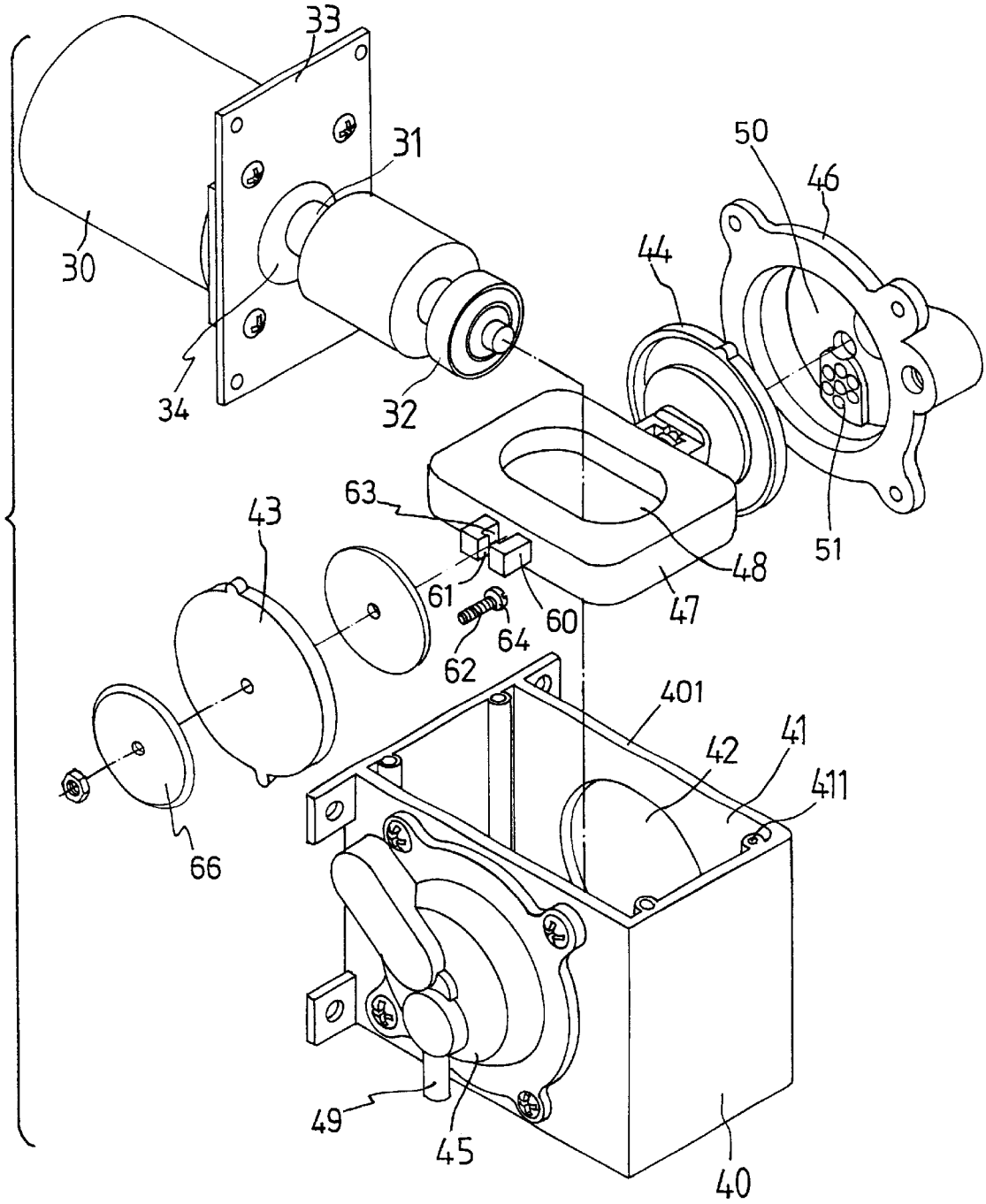
FIG. 1 is an exploded view of a pressurized air supplying device for a vehicle in accordance with the present invention.
Figure 2:
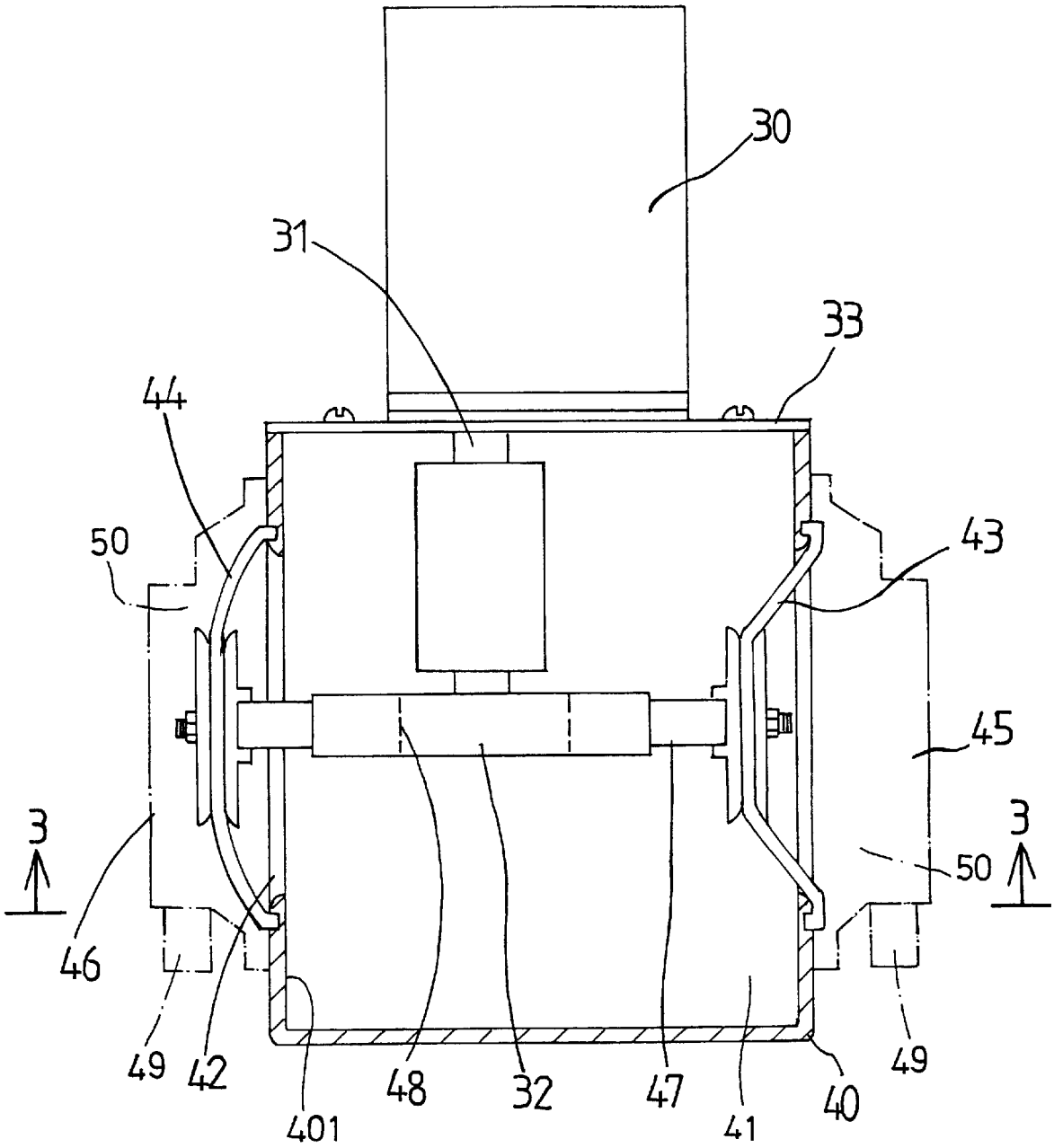
FIG. 2 is a cross sectional view taken along lines 2—2 of FIG. 3.
Figure 3:
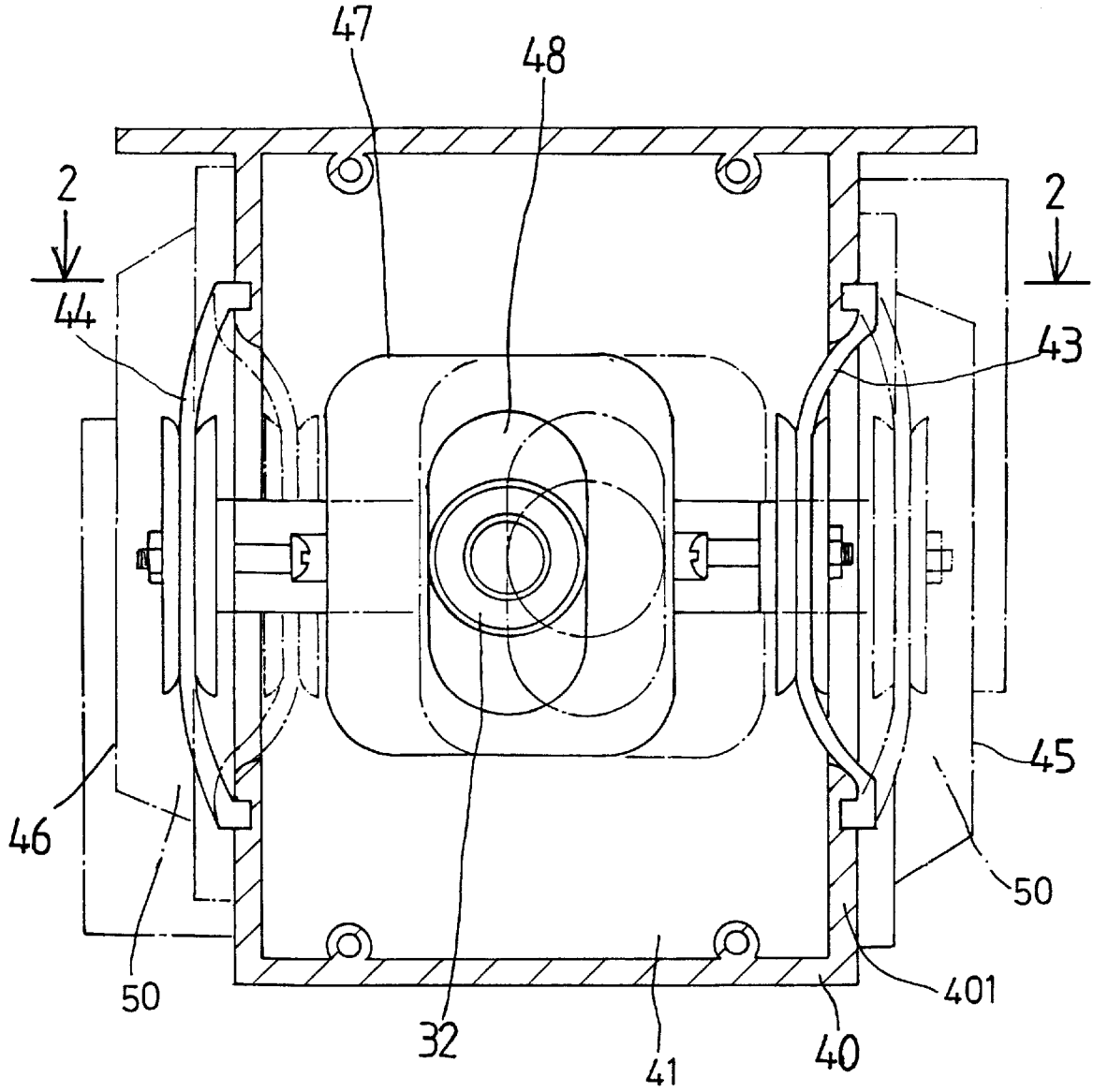
FIG. 3 is a cross sectional view taken along lines 3—3 of FIG. 2.

Referring to the drawings, a pressurized air supplying device for a vehicle in accordance with the present invention is provided for supplying a pressurized air to a massage device for the vehicle.

The present inventor has developed various kinds of massage devices for vehicles. Two of the massage devices for the vehicles are disclosed in U.S. patent application Ser. No. 09/296,392, filed on Apr. 23, 1999, and U.S. patent application Ser. No. 09/310,782, filed on May 14, 1999, which are taken as a reference for the present invention. The massage devices are not related to the present invention and will not be described in further details. The pressurized air supplying device in accordance with the present invention is particularly provided for being attached to the vehicle and energized by the direct current (DC) of the vehicle for generating and supplying the pressurized air to the vehicle and to actuate the pneumatic activated massage devices of the vehicle.

The pressurized air supplying device in accordance with the present invention comprises a housing 40 including a hollow interior 41 formed and provided therein and including an open top and including one or more hubs 411 provided on the upper peripheral portion thereof for receiving fasteners. The housing 40 includes a pair of opposite openings 42 formed in the side walls 401 thereof respectively and communicating with the interior 41 of the housing 40. Two films or membranes 43, 44 are disposed in the openings 42 of the housing 40 and have the peripheral portion secured to the housing 40 with two casings 45, 46 respectively. The casings 45, 46 each includes a chamber 50 formed therein and formed between the respective casings 45, 46 and the membranes 43, 44, and each includes an outlet port 49 coupled to the massage devices for supplying the pressurized air to the massage devices.

A follower 47 is received in the interior 41 of the housing 40 and includes two sides each having an ear 60 provided thereon or attached thereto, best shown in FIG. 1. The ears 60 each includes a groove 61 formed therein for receiving a fastener 62 and each includes a shoulder 63 formed therein for receiving the head 64 of the fastener 62 and for allowing the fasteners 62 to be secured to the ears 60 of the follower 47. Two discs 66 are provided and engaged on both sides of each of the membranes 43, 44. The fasteners 62 are engaged through the discs 66 and the respective membranes 43, 44 and secured to the membranes 43, 44 for securing the follower 47 between the membranes 43, 44. The follower 47 includes an oblong hole 48 formed therein.

A motor 30 is secured to a plate 33 which is engaged on the housing 40 for enclosing the hollow interior 41 of the housing 40 and which may be secured to the housing 40 with such as fasteners and which may be formed as a top wall of the housing 40.

It is to be noted that the motor 30 may be coupled to and energized by the DC power of the vehicle such that the motor 30 may be actuated by the motor of the vehicle in order to move the membranes 43, 44 in the reciprocating action so as to generate the pressurized air and so as to supply the pressurized air to the massage device for the vehicle. The eccentric position of the axle 31 relative to the spindle 34 of the motor 30 may be selected or determined by the manufacturers in order to determine the moving stroke of the follower 47 and the membranes 43, 44. The manufacturers may change the eccentric position of the axle 31 relative to the spindle 34 of the motor 30 so as to adjust the moving stroke of the follower 47 and the membranes 43, 44. The motor 30 may also be changed or selected from the other types by the manufacturers who may select the motors 30 of different powers in order to drive the follower 47 in different speeds. Or, an adjusting device may be provided for adjusting the power supplied to the motor in order to adjust the rotational speed of the motor and in order to adjust the pumping effect of the membranes.

Accordingly, the pressurized air supplying device may be attached to the vehicle and energized by the DC current of the vehicle for generating and supplying the pressurized air to the vehicle and to actuate the pneumatic activated massage devices of the vehicle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A pressurized air supplying device for generating and supplying a pressurized air to a massage device of a vehicle, said pressurized air supplying device comprising:

a housing including a pair of opposite sides each having an opening formed therein, a pair of membranes secured to said opposite sides of said housing respectively for enclosing said openings of said housing, said membranes each including a peripheral portion, a pair of casings secured to said opposite sides of said housing and engaged with said peripheral portions of said membranes to secure said peripheral portions of said membranes between said housings and said casings respectively, said casings each including an outlet port for outputting air, and means for moving said membranes relative to said casings respectively to pressurize an air received in said casings and to generate a pressurized air and to supply the pressurized air out through said outlet ports of said casings respectively, said moving means including a follower slidably received in said housing and having two sides secured to said membranes respectively for moving said membranes relative to said casings respectively, and means for actuating said follower to move said membranes relative to said casings respectively.

2. The pressurized air supplying device according to claim 1, wherein said follower includes an oblong hole formed therein, said actuating means includes a motor secured to said housing and having an eccentric axle extended therefrom and engaged in said oblong hole of said follower to actuate said follower to move said membranes relative to said casings respectively.

3. The pressurized air supplying device according to claim 1, wherein said follower includes two sides each having an ear provided thereon, a pair of fasteners secured in said ears of said follower respectively and secured to said membranes for securing said sides of said follower to said membranes.

4. The pressurized air supplying device according to claim 3, wherein said ears each includes a groove formed therein for receiving said fastener, and each includes a shoulder formed therein, said fasteners each includes a head engaged with said shoulder of said ear for securing said fastener to said ear respectively.

5. The pressurized air supplying device according to claim 1, wherein said casings each includes a check valve attached thereto to control the air to flow into said casings only and to prevent the air in said casings from flow out of said casings respectively.

* * * * *